US005564854A

United States Patent [19]

Hedgewick

[11] Patent Number: 5,564,854

[45] Date of Patent: Oct. 15, 1996

[54] SNOWPLOWABLE ROAD MARKER

[75] Inventor: Peter Hedgewick, Windsor, Canada

[73] Assignee: Pac-Tec, Inc., Heath, Ohio

[21] Appl. No.: 290,485

[22] Filed: Aug. 15, 1994

Related U.S. Application Data

[63] Continuation-in-part of Ser. No. 69,599, Jun. 1, 1993, abandoned, which is a continuation-in-part of Ser. No. 822,542, Jan. 17, 1992, Pat. No. 5,308,186, which is a continuation-in-part of Ser. No. 527,754, May 23, 1990, Pat. No. 5,098,217.

[51] Int. Cl.[6] ..... G08B 5/00

[52] U.S. Cl. ..... 404/14; 404/16

[58] Field of Search ..... 404/14, 16, 12, 404/13, 15

[56] References Cited

U.S. PATENT DOCUMENTS

| | | | |
|---|---|---|---|
| 3,587,416 | 6/1971 | Flanagan | 94/1.5 |
| 3,938,903 | 2/1976 | Montgomery | 404/16 |
| 4,155,666 | 5/1979 | Flanagan | 404/16 |
| 4,195,945 | 4/1980 | Heenan | 404/16 |
| 4,232,979 | 11/1980 | Johnson et al. | 404/16 |
| 4,402,628 | 9/1983 | Grenier et al. | 404/16 |
| 4,557,624 | 12/1985 | Walker | 404/14 |
| 4,577,992 | 3/1986 | Jefferies | 404/16 |
| 5,104,256 | 4/1992 | D'Avela | 404/14 |
| 5,226,745 | 7/1993 | Gartlacher | 404/14 |

*Primary Examiner*—Roger J. Schoeppel

*Attorney, Agent, or Firm*—Gifford, Krass, Groh, Sprinkle, Patmore, Anderson & Citkowski P.C.

[57] ABSTRACT

A low profile snowplowable road marker and method of installation is disclosed. The snowplowable road marker has a circular dome section having a pair of deflectors which wrap/encircle a signalling device along a circumferential edge of the marker. The deflectors are separated by a gap to permit drainage. The deflectors have wedge shaped ends to lift the snowplow over the signalling device. The circumferential edge is radiused and mounted in a bore as to be below the level of the road surface.

9 Claims, 3 Drawing Sheets

SNOWPLOWABLE ROAD MARKER

CROSS-REFERENCE TO RELATED APPLICATIONS

This is a continuation-in-part of U.S. patent application Ser. No. 07/069,599, filed Jun. 1, 1993, entitled SNOWPLOWABLE ROAD MARKER, now abandoned, which is a continuation-in-part of Ser. No. 822,542 filed Jan. 17, 1992 now U.S. Pat. No. 5,308,186, issued May 3, 1994, entitled SNOWPLOWABLE ROAD MARKER, which is a continuation-in-part of Ser. No. 527,754, filed May 23, 1990, U.S. Pat. No. 5,098,217, issued Mar. 24, 1992, entitled REFLECTIVE PAVEMENT MARKER WITH PROTECTIVE RIM.

I. Field of the Invention

The present invention relates to road markers for reflecting the light of oncoming vehicles. More particularly, the present invention relates to snowplowable road markers.

II. Background of the Invention

Road markers are known for marking traffic lanes and controlling the flow of traffic. Typically, the road markers have a body molded of plastic material and include one or more reflectors to return the light from the headlights of oncoming vehicles. The body is mounted directly on the top surface of the road as disclosed in U.S. Pat. No. 4,753,548.

However, in geographic areas where there is sufficient snowfall to require the use of snowplows to remove the snow, it has been found that snowplow blades frequently damage road markers or remove the markers from the road. To overcome this problem it is known, such as disclosed in U.S. Pat. No. 3,587,416, to form a metal casting having a pair of spaced apart ramps mounted in the roadway surface. A cube-type corner retro reflector is mounted in the casting between the pair of ramps so that a snowplow blade will ride up the ramps and pass over the reflector without damaging the reflector.

Because vehicles frequently pass over the snowplowable road markers, it is advantageous to minimize the height of the road marker extending above the road surface to minimize the disturbance to the handling of the vehicle when passing over the road markers.

It is known, as disclosed in U.S. Pat. No. 4,402,628 discloses a circular sheet metal base having a raised protected cross-rib extending between a pair of raised side members. The protective rib extends between a pair of markers which are disposed in channels extending radially from each side of the rib. However, it has been found that snowplow blades will slice through the sheet metal pavement markers such as disclosed in U.S. Pat. No. 4,402,628.

It is also known, as disclosed in U.S. Pat. No. 4,577,992, to form a circular casting having a dished top surface with an open channel formed in the top surface so that a snowplow blade is deflected by the dished top surface. However, it has been found that snowplow blades may be angled as much as 60° to the axis of the roadway. In such situations the blade may enter the channel between the ramps, or lifting surfaces and damage or remove the retroreflector.

SUMMARY OF THE INVENTION

The present invention overcomes these problems and provides a snowplowable road marker which has a low profile and is not easily removed from the road surface by snowplow blades. Additionally, the snowplowable marker of the present invention provides protection for the reflector from contact by a sharply angled blade of a snowplow.

In a preferred embodiment of the invention, the snowplowable road marker has at least one cube corner retro reflector mounted in a base member. The base member has a circular dome portion and a downwardly extending skirt portion for securing the marker to the roadway. The retro reflector is mounted within a diametrical cavity extending between two snowplow blade deflectors forming the dome portion. The deflectors have a dished surface which generally surround the reflector to deflect the blades of the snowplow from catching and dislodging the casting from the road regardless of the angle of the blades. The deflectors are positioned with tapered end portions positioned on circumferentially on either side of the markers. The tapered end portions thus permit light to contact the reflector and be reflected to an oncoming vehicle.

A lower surface extends between the legs of the skirt. A circular bore is formed in the road surface for receiving the legs and forming a cylindrically core. The top of the core is faced off or removed to support the lower surface of the base member below the road surface. The based member has a radiused peripheral edge which is positioned at the road surface so that the snowplow blade rides up the radiused edge over the deflectors and does not catch the marker thereby preventing inadvertent removal of the marker. A plurality of notches are formed in a bottom surface of the cavity to facilitate removal and replacement of the reflector.

BRIEF DESCRIPTION OF THE DRAWING

The objects, features, and advantages of the present invention will be readily apparent from the detailed description of the invention taken in connection with the accompanying drawing.

DETAILED DESCRIPTION OF THE PREFERRED EMBODIMENT

Figure 1:
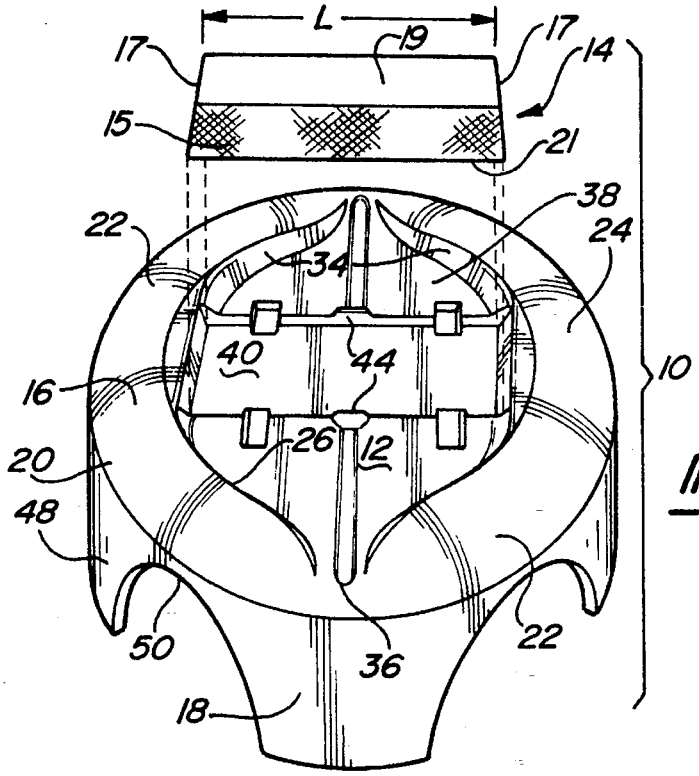
FIG. 1 is an exploded perspective view of a snowplowable road marker according to the invention.

A preferred embodiment of a snowplowable road marker 10 according to the invention is shown in FIG. 1. The road marker 10 includes a base member 12 and at least one cube corner type retro reflector 14. The reflector 14 may be any conventional retro reflective device such as a cube corner or glass eye reflector. In the preferred embodiment the reflector 14 is a trapezoidal retro reflector having two opposed reflective lenses 15 having predetermined length "6" extending between a pair of ends 17, top 19 and bottom 21. However, a device having only one reflective lens or two devices each having one lens may be used.

As best shown in FIG. 1, the base member 12 is circular and has a domed portion 16 with a skirt portion 18 extending downwardly from the domed top portion. The domed portion 16 has a radiused outer circumferential edge 20. The circumferential edge 20 is radiused between the top portion 16 and the skirt 18 so that there is no sharp edge adjacent the road surface to catch the snowplow blade as it engages the marker.

Figure 2:
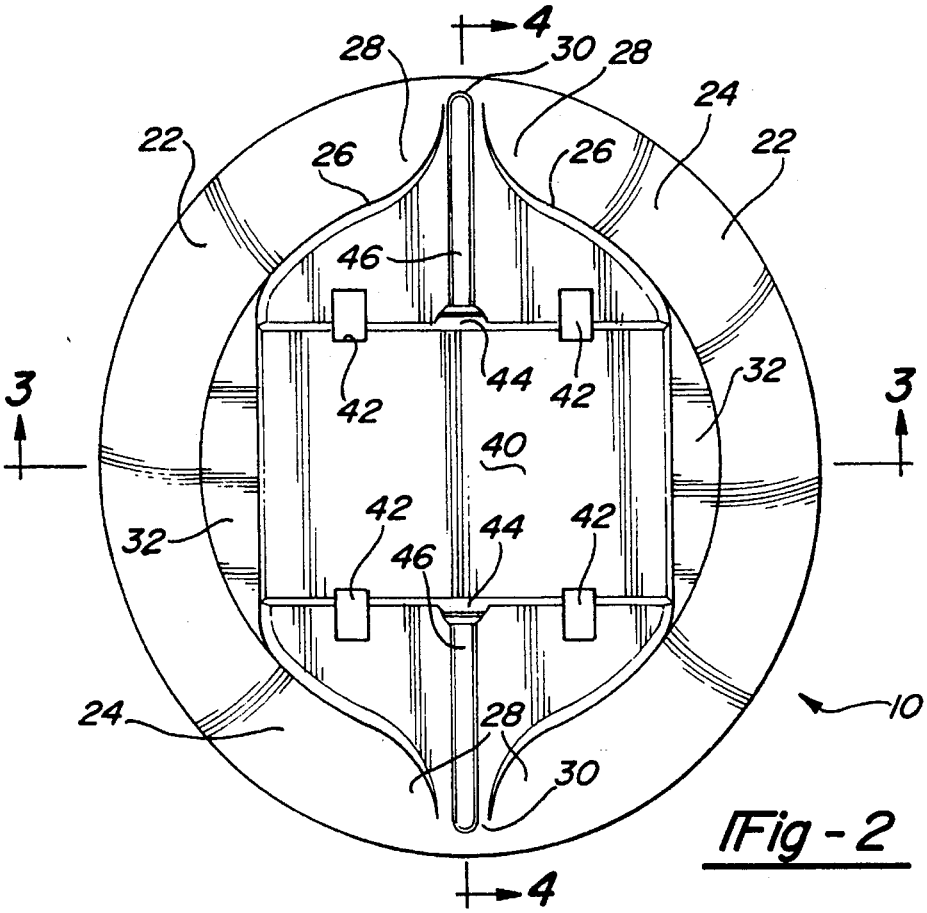
FIG. 2 is a top view of a snowplowable road marker in accordance with the invention.
Figure 3:
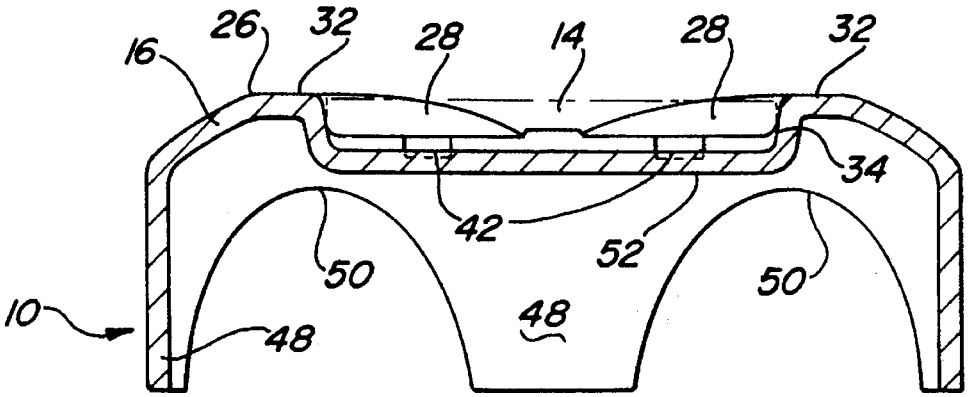
FIG. 3 is a cross-sectioned side view of the snowplowable road marker taken along lines 3—3 of FIG. 2 according to the invention.

As best shown in FIGS. 1 and 2, the domed top section 14 has a pair of opposed and generally mirror imaged C-shaped snowplow blade deflectors 22. The deflectors have an inverted dished surface 24 extending upwardly and inwardly from circumferential edge 20 to an upper ridge 26. Each deflector 22 has a pair of tapered end portions 28 as best shown in FIGS. 1 and 3. The end portions 28 of the deflectors 22 extend upwardly from either side of a radially extending gap 30 formed between the deflectors 22. Each gap 30 and the tapered end portions 28 are disposed radially outwardly from the lenses 15 of the deflector 14. Each upper ridge 26 begins at the gap and extends inwardly from near the circumferential edge 20. As the distance between the outer circumferential edge and upper ridge increases the height of the deflector increases until it is slightly above the height of the retro reflector. A flat surface 32 extends horizontally from the upper ridge 26 of the dished surface 24 to an inner surface 34 of the deflector. The flat surface 32 extends beyond the width of the top 19 of the retro reflector 14 and acts to guide the snowplow blade over the retro reflector 14.

The retro reflector 14 is mounted in a rectangular recess 40 formed in the bottom surface 38 of cavity 40 and the inner surfaces 34 of the deflector 22. The reflector 14 is mounted in the recess 40 with suitable adhesive such as an epoxy. Two pairs of slots 42 are formed in the bottom surface 38 at either side of the recess 40 to provide for insertion of a tool, such as screwdriver, to extend under the bottom 21 of the reflector 14 to facilitate removal of reflector 14 for replacement in case the reflector is damaged. A pair of tabs 44 are centrally disposed on either side of the recess to further hold the reflector 14 from displacement. A radial channel 46 extends from each tab 44 outwardly to the gap 30 between the deflectors 22 to facilitate drainage of rain water which may enter the cavity.

Figure 4:
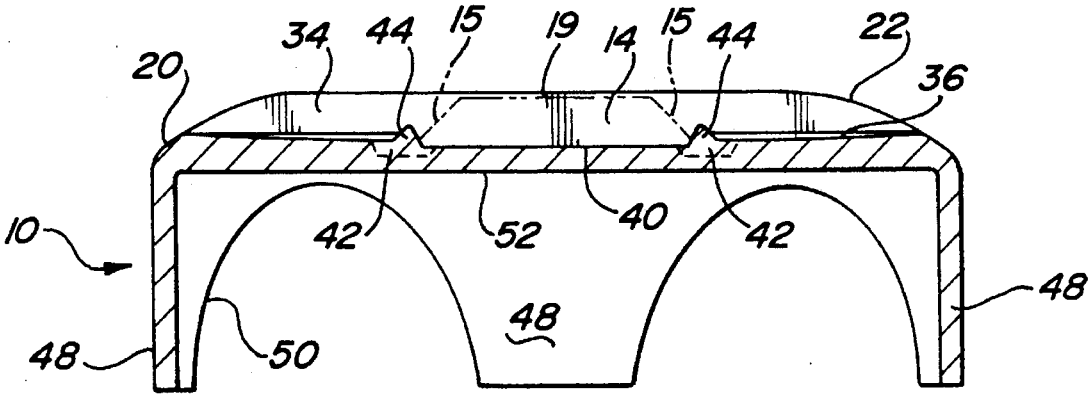
FIG. 4 is a cross-sectional side view of the snowplowable road marker in accordance with the invention taken along lines 4—4 of FIG. 2.

As shown in FIGS. 3 and 4, the skirt portion 18 extends down from the circumferential edge 20. The skirt portion 18 has four legs 48 which alternate between arch-like openings 50. The legs 48 are formed in this manner to provide strength to the legs and circumferential edge. The base member has a generally flat lower surface extending under the bottom surface of the cavity for which is provided for supporting a marker on roadway surfaces as discussed below. The base member is preferably formed in one of cast metal such as iron.

Figure 5:
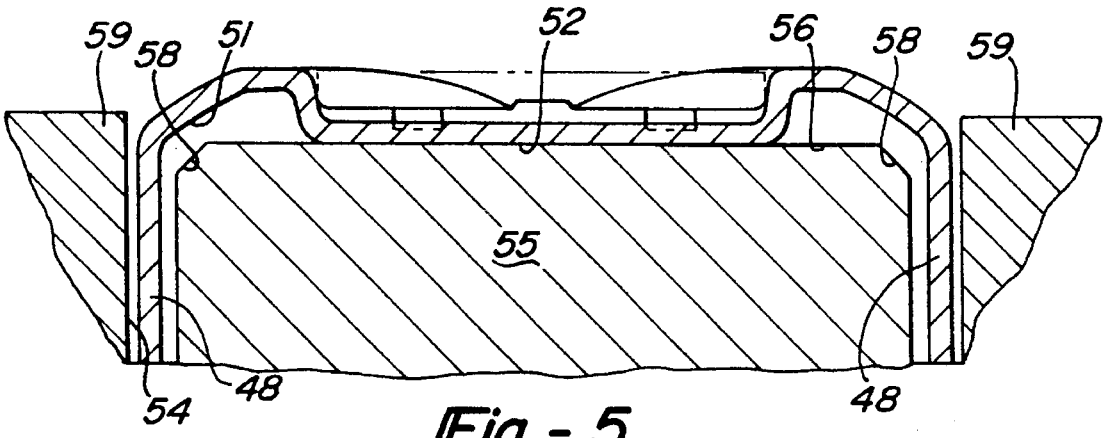
FIG. 5 is a cross-sectional view of a section of roadway bored for mounting the snowplowable road marker.

As is shown in FIG. 5, the base member 14 is mounted in a roadway 59 by forming an outer cylindrical bore 54 having sufficient depth to freely accept the legs 48 of the base member. The bore 54 forms a center core 55 having a top surface 56. The lower surface 52 of the base member rests on the top surface 56 of the core. The top surface 56 is preferably provided with a beveled circumferential portion 58 to permit clearance for an inner radiused surface 51 which is formed under the circumferential edge of the base member.

Figure 6:
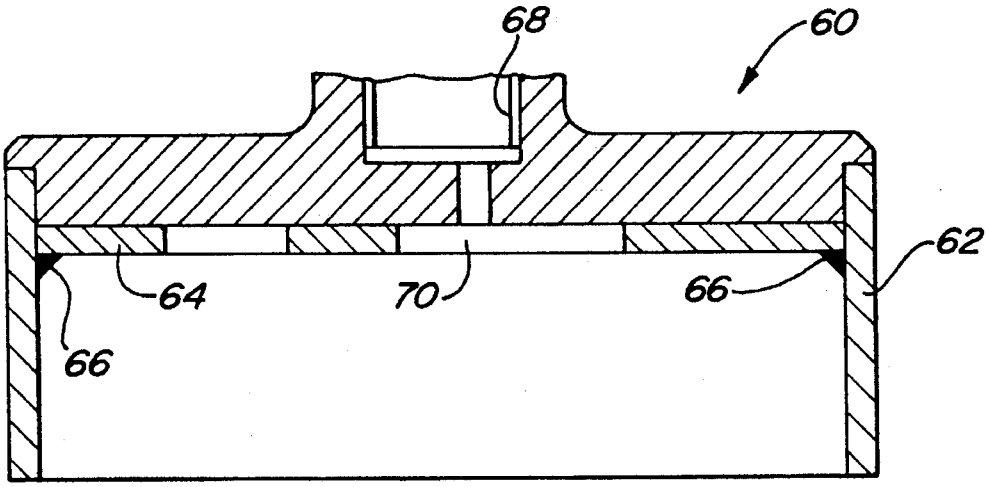
FIG. 6 is a cross-sectional view of a cutting tool suitable for use in forming a bore for mounting the road marker.

The outer bore 54 and top surface 56 of the core 55 may be formed in a single cutting process with a cutting and facing tool 60 as shown in FIG. 6. The tool 60 is provided with a circular blade 62 for cutting the outer bore 54 and a series of radially spaced bits 64 to face the top of the core 55. Additionally, cutters 66 may be provided to cut the beveled circumferential portion 58 around the top of the core 55. In the preferred embodiment, the cutting tool 60 is provided with a bore 68 for mounting the tool to a standard pavement cutter (not shown). The tool 60 also includes a series of central apertures 70 to permit injection of water under pressure which cools the cutting tool and dramatically increases the life of the tool. The outer bore 54 is cut to a suitable depth, such as approximately 1⅞", and the top of the core is faced to a depth of approximately 3/16". A stop (not shown) may be attached to the cutting machine to maintain the level of the cutting tool 60 so that it will face the core 55 to the desired depth to position the surface 38 of the cavity on the plane of the road surface 59.

After the outer bore 54 has been drilled to the proper depth and the core 55 has been faced, a suitable cementing compound, such as mastic, epoxy or bituminous, which contains asphalt, calcium carbonate and water, is introduced into the outer bore 54. The outer bore 54 is filled within ⅜ inch of the pavement level and the marker 10 is installed into the bore 54. The marker 10 is pressed until the lower surface 52 of the marker contacts the top surface 56 of the core 55. The base member 10 is aligned with the lens 15 of the reflectors 14 positioned in a direction orthogonal to the direction of the oncoming traffic. At a suitable time, or in the case of Armor Prep, approximately twelve hours, the bonding material will be sufficiently hardened to maintain the base member in the road.

Above have been described what are presently. considered to be the preferred embodiments of the invention, it will be understood that various modifications may be made herein, and it is intended to cover in the independent claims, all such modifications as fall within the true spirit and scope of the invention.

What is claimed is:

1. A snowplowable road marker for installation in a road having a top surface, said road marker comprising:

a metal base member having a circumferential edge portion extending between a domed portion and a skirt portion, said skirt portion extending downwardly from said domed portion for mounting said base member to said road, said domed portion having a pair of deflectors extending from said circumferential edge portion; each of said pair of deflectors having a tapered end portion curving along said circumferential edge from an upper ridge, said end portions of said deflectors defining a gap between said pair of deflectors having a predetermined width; and a signalling device mounted to said base member between said upper ridges of said pair of deflectors, said signalling device having at least one lens having a predetermined length substantially greater than said predetermined width of said gap, said reflective surface being spaced radially inwardly from said gap and said end of said pair of deflectors.

2. The snowplowable road marker as claimed in claim 1, wherein said dome portion comprises a lower surface having at least one recess for mounting said at least one deflector.

3. The snowplowable road marker as defined in claim 1, wherein said base member comprises a circumferential edge portion.

4. The snowplowable road marker as defined in claim 3, wherein said circumferential edge portion is radiused.

5. The snowplowable marker as defined in claim 2, wherein said lower surface has at least one slot extending to said recess to permit insertion of a tool for removal of said signalling means.

6. A snowplowable road marker for installation into a roadway, said road marker comprising:

a reflector member;

a base member having an upper portion and a lower portion, said upper portion having a generally planar surface having a recess adapted to receive said reflector member for mounting said reflector member to said base member, said reflector member and planar surface being positioned between a pair of upwardly sloping deflectors, at least one slot formed in said planar surface to extend into said recess adjacent said reflector member for facilitating removal of said reflector member from said base member, said base member having at least one downwardly extending portion adapted to be received in said roadway for mounting said base member in said roadway; and means for demountably affixing said reflector member to said base member.

7. The snowplowable road marker as defined in claim 6, wherein said reflector member comprises a cube corner reflex reflector.

8. The snowplowable marker of claim 6, wherein each of said pair of deflectors comprises a ramp surface extending parallel to said top surface of said road.

9. The snowplowable road marker as defined in claim 6, wherein said base member further includes a circumferential edge portion being radiused between a dome portion and skirt portion such that said edge portion extends below said top surface of said road when said marker is installed in said road.

* * * * *

UNITED STATES PATENT AND TRADEMARK OFFICE

CERTIFICATE OF CORRECTION

PATENT NO. : 5,564,854

DATED : October 15, 1996

INVENTOR(S) : Peter Hedgewick

It is certified that error appears in the above-indentified patent and that said Letters Patent is hereby corrected as shown below:

In the abstract, line 6, delete "wrap";

Column 1, line 6, delete "07/069,599", insert --08/069,599--;

line 45, delete "It is known, as disclosed in".

Column 2, line 21, delete "cylindrically", insert --cylindrical--;

line 23, delete "based", insert --base--;

line 36, delete "drawing", insert --drawings".

Column 3, line 3, delete "top"; after "portion", insert --16--;

line 5, delete "top", insert --domed--;

line 9, delete "top section 14", insert --portion 16--;

line 23, delete "deflector" insert --reflector--;

line 24, after "reflector" insert --14--;

UNITED STATES PATENT AND TRADEMARK OFFICE

CERTIFICATE OF CORRECTION

PATENT NO. : 5,564,854

DATED : October 15, 1996

INVENTOR(S) : Peter Hedgewick

It is certified that error appears in the above-indentified patent and that said Letters Patent is hereby corrected as shown below:

Column 3, line 26, after "deflector", insert --22--;

line 31, delete "of cavity 40"; after "and", insert --between--;

line 49, after "surface", insert --52--;

line 50, delete "for" (first occurrence);

line 54, after "member", delete "14" and insert --12--.

Column 4, line 11, after "core", insert --55-- line 57, delete "end", insert --ends--.

Signed and Sealed this

Eleventh Day of March, 1997

*Attest:*

*Attesting Officer*

BRUCE LEHMAN

*Commissioner of Patents and Trademarks*